US010286526B2

(12) United States Patent
Su

(10) Patent No.: US 10,286,526 B2
(45) **Date of Patent: *May 14, 2019**

(54) CLENCH WRENCH

(71) Applicant: Hong Ann Tool Industries Co., Ltd., Taichung (TW)

(72) Inventor: Cheng-Wei Su, Taichung (TW)

(73) Assignee: Hong Ann Tool Industries Co., Ltd., Taichung (TW)

( * ) Notice: Subject to any disclaimer, the term of this patent is extended or adjusted under 35 U.S.C. 154(b) by 152 days.

This patent is subject to a terminal disclaimer.

(21) Appl. No.: 15/387,824

(22) Filed: Dec. 22, 2016

(65) Prior Publication Data

US 2017/0100820 A1 Apr. 13, 2017

Related U.S. Application Data

(63) Continuation-in-part of application No. 14/994,220, filed on Jan. 13, 2016, now Pat. No. 9,849,569.

(30) Foreign Application Priority Data

Mar. 18, 2015 (TW) ..... 104108634 A

(51) Int. Cl.
*B25B 13/06* (2006.01)
*B25B 13/46* (2006.01)
(Continued)

(52) U.S. Cl.
CPC ..... *B25B 13/468* (2013.01); *B25B 13/06* (2013.01); *B25B 13/463* (2013.01);
(Continued)

(58) Field of Classification Search
CPC ..... B25B 23/0057; B25B 23/0071; B25B 13/467
(Continued)

(56) References Cited

U.S. PATENT DOCUMENTS 145,399 A * 12/1873 Colbert ..... B25B 13/466 81/58.3
221,299 A 11/1879 Gray
(Continued)

FOREIGN PATENT DOCUMENTS

CN 203566583 U 4/2014
TW 483359 U 4/2002
(Continued)

*Primary Examiner* — Hadi Shakeri
(74) *Attorney, Agent, or Firm* — Alan D. Kamrath; Kamrath IP Lawfirm, P.A.

(57) ABSTRACT

A clench wrench includes a structure defining a handle and an engaging head. The engaging head has a front side and a back side and includes an engaging space extending through the front and back sides. The engaging space defines an opening on both the front and back sides. A clenching device is mounted on the engaging head and includes a clenching member. The clenching member includes a clenching portion and is operable in a first mode in which the clenching portion is located at a first position capable of clenching the object engaged with the engaging head, and in a second mode in which the clenching portion is disposed away from the engaging space and is located at a second position capable of letting the object engaged with the engaging head to disengage therefrom.

14 Claims, 6 Drawing Sheets

(51) Int. Cl.
*B25B 23/00* (2006.01)
*B25G 1/06* (2006.01)

(52) U.S. Cl.
CPC ..... *B25B 23/0057* (2013.01); *B25B 23/0071* (2013.01); *B25G 1/063* (2013.01)

(58) Field of Classification Search
USPC ..... 81/60
See application file for complete search history.

(56) References Cited

U.S. PATENT DOCUMENTS 625,149 A * 5/1899 Crocker ..... B25B 13/463 81/63
2,751,802 A 6/1956 Reuillard
2,757,564 A * 8/1956 Reaves ..... B25B 13/463 81/58.2
4,993,725 A * 2/1991 Barnes ..... A63C 1/24 280/11.14
6,481,315 B1 11/2002 Chang et al.
6,752,046 B1 6/2004 Lee
6,871,570 B1 3/2005 Santillan
6,889,581 B2 * 5/2005 Chen ..... B25B 13/04 81/125
6,948,406 B1 9/2005 Li
8,261,635 B2 9/2012 Lee et al.
9,205,538 B2 * 12/2015 Yang ..... B25B 13/463
9,308,631 B2 * 4/2016 Shyu ..... B25B 13/463
9,393,676 B2 7/2016 Weber
9,592,594 B2 * 3/2017 Chen ..... B25B 23/108
9,789,593 B2 * 10/2017 Kao ..... B25B 13/463

FOREIGN PATENT DOCUMENTS

TW 547258 U 8/2003
TW 551251 U 9/2003
TW M476030 U 4/2014
TW M492226 U 12/2014
TW M494064 U 1/2015

* cited by examiner

CLENCH WRENCH

CROSS REFERENCE TO RELATED APPLICATION

The present application is a continuation-in-part application of U.S. patent application Ser. No. 14/994,220 filed on Jan. 13, 2016, now U.S. Pat. No. 9,849,569.

BACKGROUND OF THE INVENTION

1. Field of the Invention

The present invention relates to a wrench and, particularly, to a clench wrench.

2. Description of the Related Art

TW Pat. No. M476030 teaches a ratcheting box wrench. The wrench includes a ratchet wheel and an engaging hole. The engaging hole is adapted to receive a socket or an object to be wrenched. The engaging hole is defined by an inner periphery of the ratchet wheel. The socket is prevented from disengaging from the wrench by a resilient C-clip. The C-clip can prevent the object to be wrenched from disengaging from the wrench. In order to receive the C-clip, a groove is defined on an outer periphery of the ratchet wheel, and a plurality of openings extends through the inner and outer peripheries of the ratchet wheel. Thus, the C-clip is partially disposed in the hole and can abut an outer periphery of the socket.

The ratchet wheel has a complex design and has a high cost of manufacture. Furthermore, the C-clip can disengage from the ratchet wheel inadvertently when forcing the object to be wrenched to disengage from the hole, and it is difficult to reengage the C-clip with the ratchet wheel. Additionally, when the socket or the object is too slippery to grasp, a user often encounters difficulty to overcome the C-clip's restraining force to disengage the socket or the object from the hole if the socket or object is too slippery to grasp.

The present invention is, therefore, intended to obviate or at least alleviate the problems encountered in the prior art.

SUMMARY OF THE INVENTION

According to the present invention, a clench wrench includes a structure including a first body defining a handle for a user to grasp and a second body defining an engaging head for engaging with an object to be clenched. The engaging head includes an engaging space for receiving the object engaged with and to be driven by the clench wrench. The engaging head has two opposite sides, with one side defining a front side and the other side defining a back side respectively, and with the engaging space extending through the front and back sides and defining an opening in each of the front and back sides. A clenching device is mounted on the engaging head, with the clenching device including a clenching member connected with the engaging head. The clenching member includes a clenching portion and is operable in a first mode in which the clenching portion is located at a first position capable of clenching the object engaged with the engaging head, and in a second mode in which the clenching portion is disposed away from the engaging space and is located at a second position capable of letting the object engaged with the engaging head to disengage therefrom.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

It is therefore an objective of the present invention to provide a clench wrench capable of preventing an object engaged therewith to disengage therefrom.

It is another objective of the present invention to allow a user to disengage the object from the clench wrench effortlessly.

Other objectives, advantages, and new features of the present invention will become apparent from the following detailed description of the invention when considered in conjunction with the accompanied drawings.

DETAILED DESCRIPTION OF THE INVENTION

Figure 1:
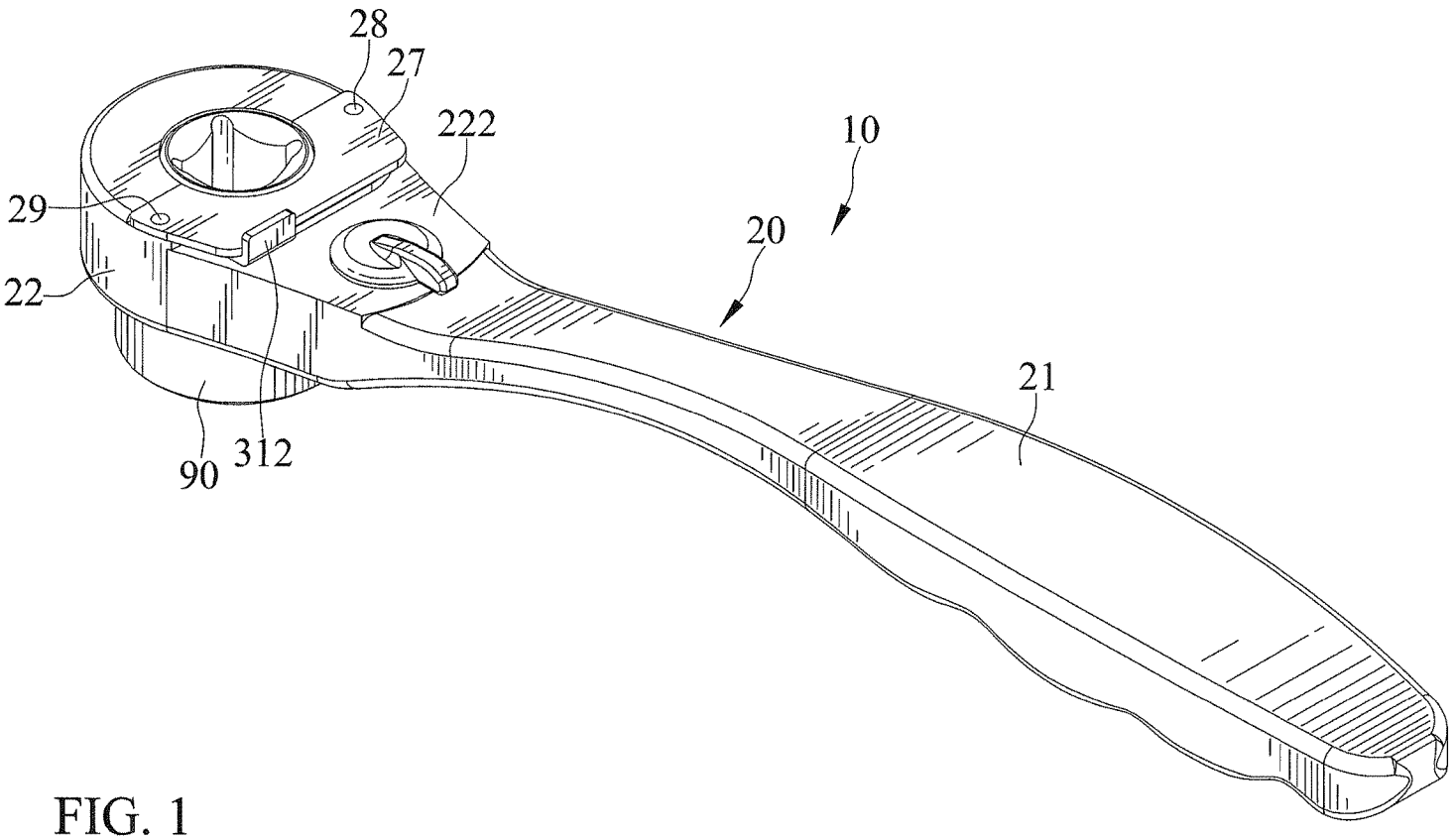
FIG. 1 is a perspective view of a clench wrench in accordance with the present invention.
Figure 2:
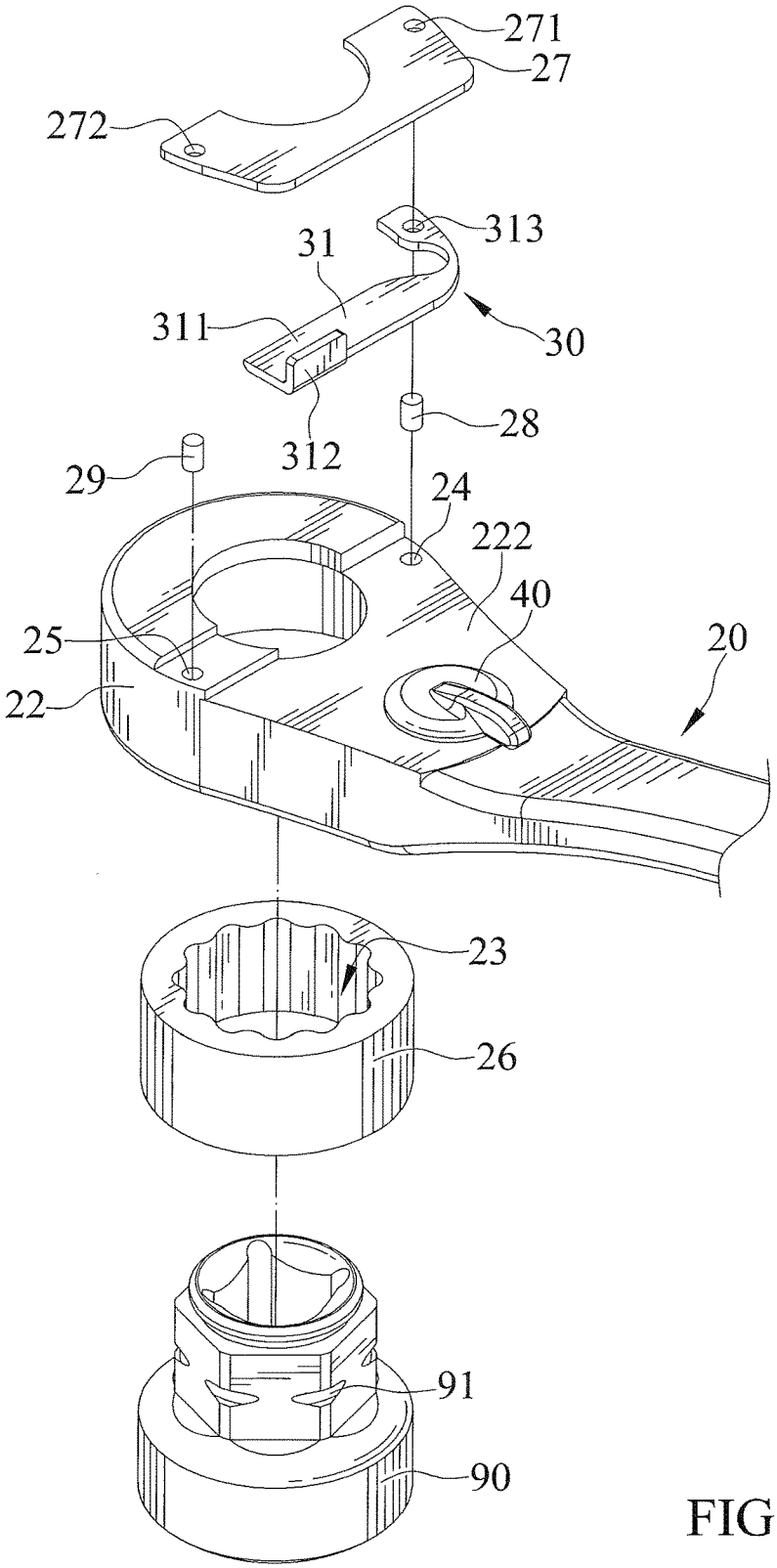
FIG. 2 is an exploded perspective view of the clench wrench of the present invention.
Figure 3:
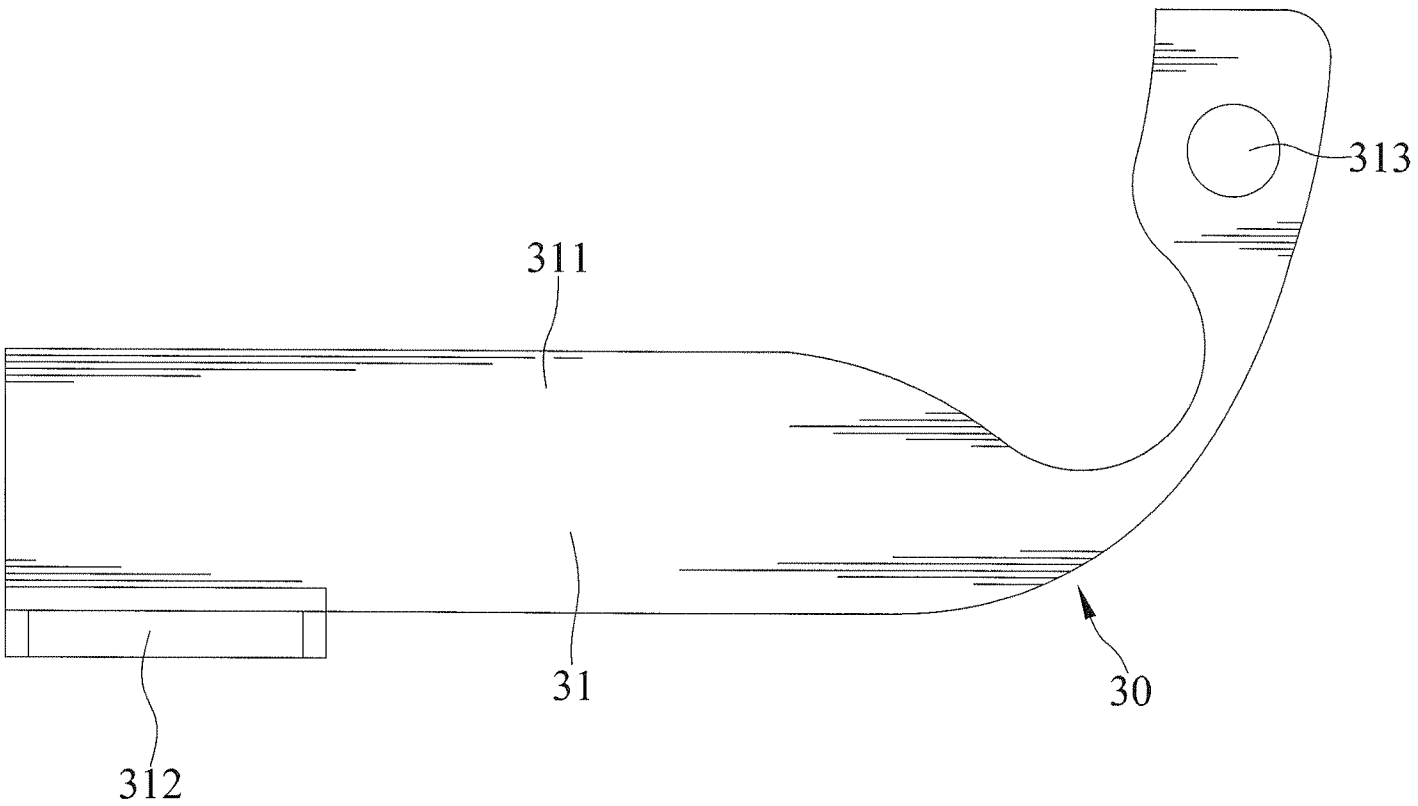
FIG. 3 is a side view of a clenching member of the clench wrench of the present invention.
Figure 4:
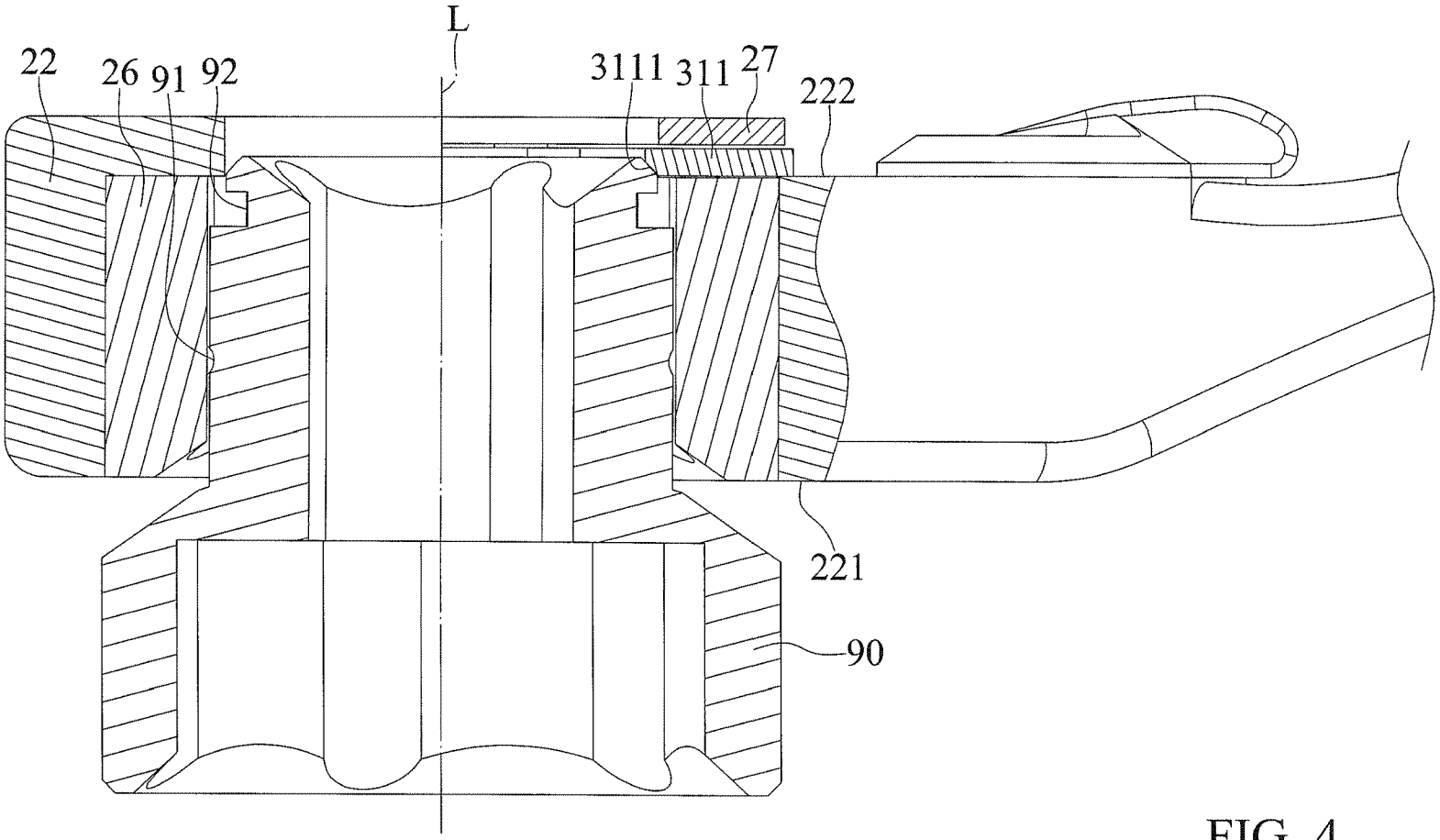
FIG. 4 is a cross-sectional view showing the clench wrench of the present invention and a socket inserted into an engaging space of the clench wrench.
Figure 5:
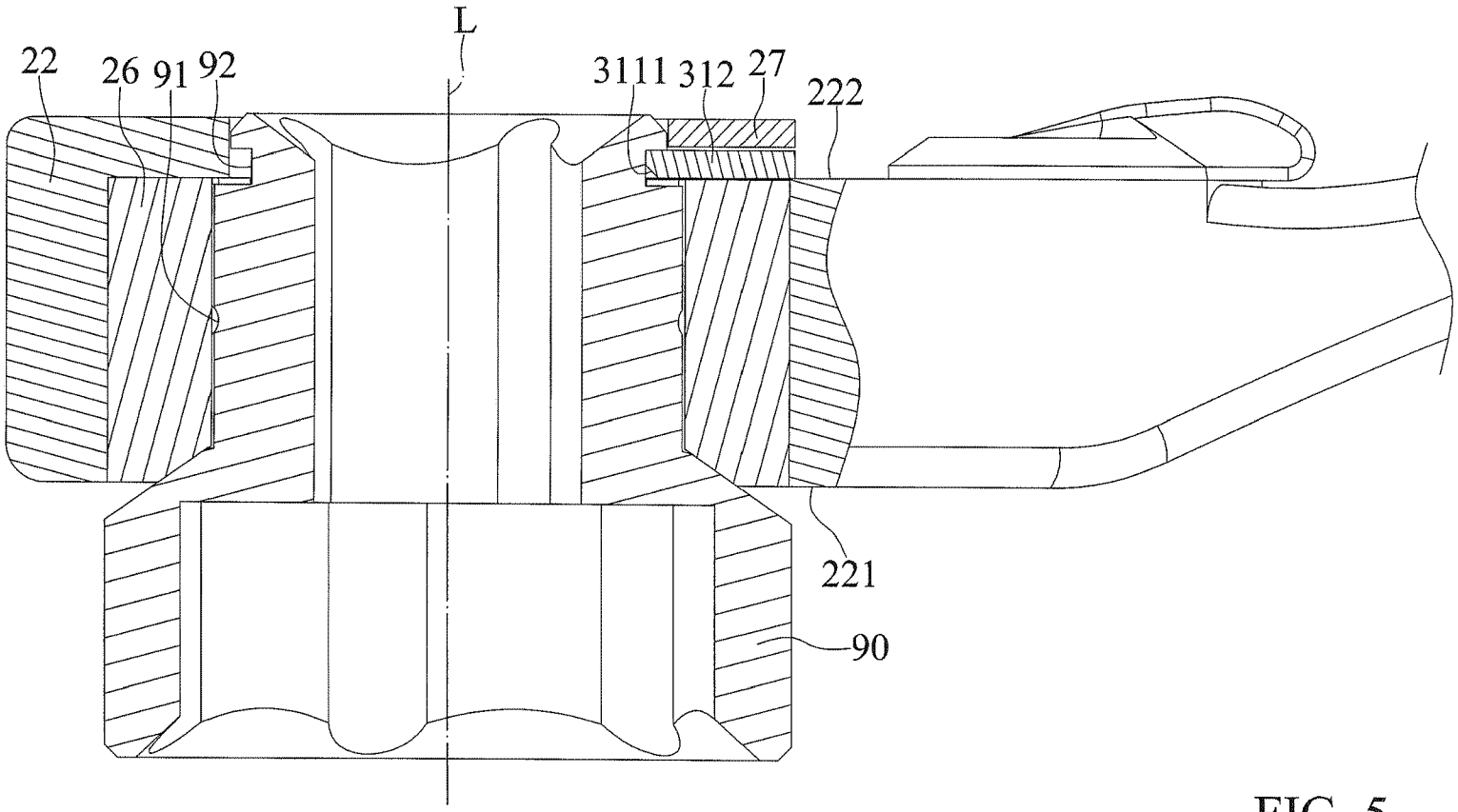
FIG. 5 is a cross-sectional view showing the clench wrench of the present invention clenching the socket, with the clench wrench preventing the socket from disengaging therefrom.
Figure 6:
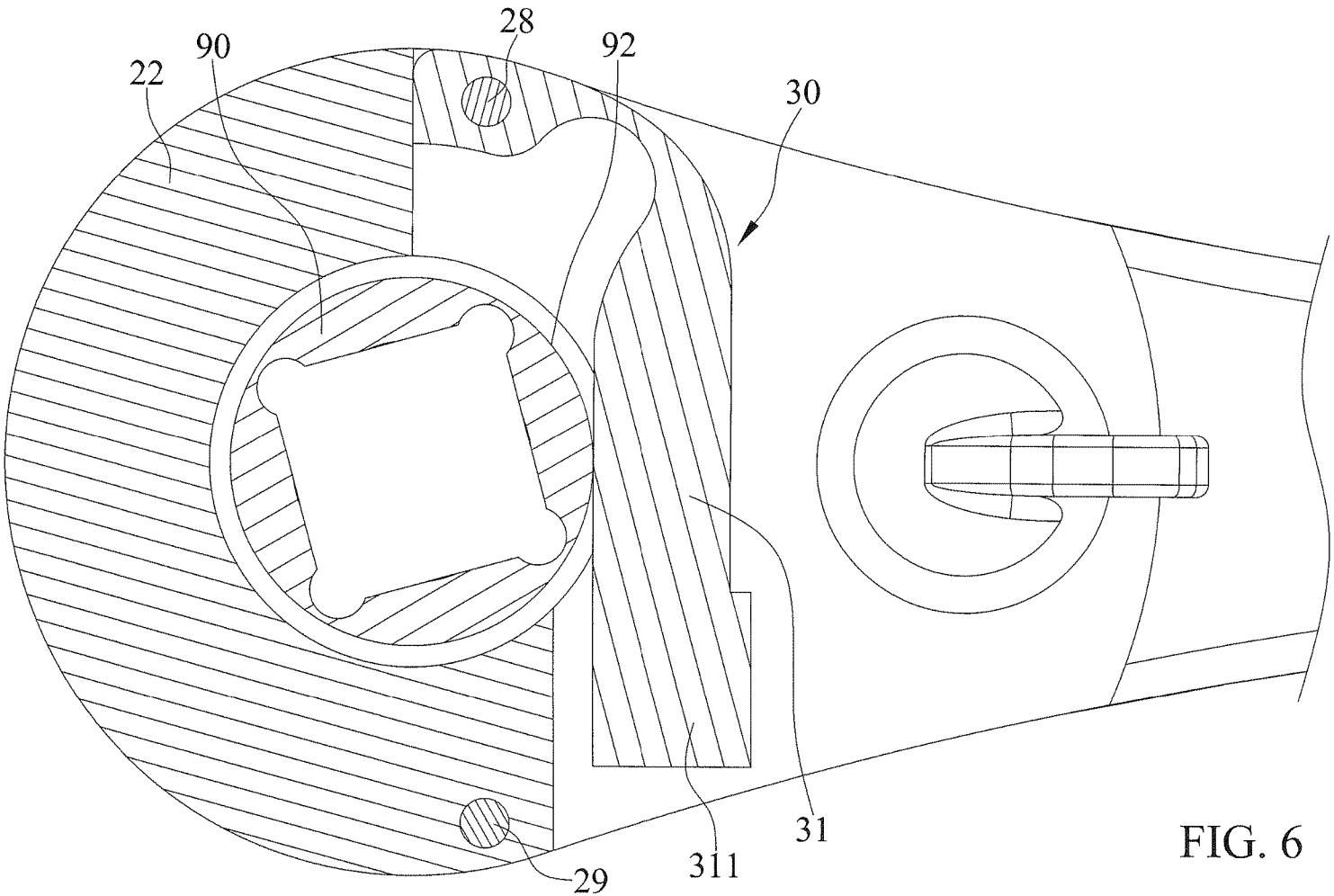
FIG. 6 is another cross-sectional view showing the clench wrench of the present invention clenching the socket.

FIGS. 1 through 6 show a clench wrench 10 in accordance with the present invention capable of preventing a socket engaged therewith from disengaging therefrom.

The clench wrench 10 has a structure 20 including a first body 21 and a second body 22. The first body 21 defines a handle for a user to grasp when operating the clench wrench 10. The second body 22 defines an engaging head for engaging with an object to be clenched. The second body 22 is integrated with the first body 21. In the embodiment, the first and second bodies 21 and 22 are defined from the one-piece structure 20, but is not limited thereto. Alternatively, the first and second bodies 21 and 22 are two separate elements and are integrated together.

The engaging head has two opposite sides with one side defining a front side 221 and the other side defining a back side 222 respectively. The distance between the front and back sides 221 and 222 define the thickness of the engaging head. The engaging head includes an engaging space 23 for receiving the object to be driven by the clench wrench 10. The engaging space 23 extends through the front and back sides 221 and 222 and defines an opening in each of the front and back sides 221 and 222. The engaging space 23 is defined by an inner periphery of a ratchet wheel 26. The ratchet wheel 26 is rotatably engaged with the engaging head and has a center of rotation about an axis L. The axis L extends in the thickness direction of the engaging head. The inner periphery of the ratchet wheel 26 is polygonal and includes ridges formed by the peripheral sides. The ridges can facilitate turning of the object by the clench wrench 10.

A clenching device 30 is mounted on the engaging head, with the clenching device 30 including a clenching member 31 connected with the engaging head. The clenching member 31 includes a clenching portion and is operable in a first mode in which the clenching portion is located at a first position capable of clenching the object engaged with the engaging head, and in a second mode in which the clenching portion is disposed away from the engaging space 23 and is located at a second position capable of letting the object engaged with the engaging head to disengage therefrom. In addition, the clenching member 31 operating in the first mode can stop the object from inserting into the engaging space 23 without being obstructed by the clenching member 31.

The clenching portion of the clenching member 31 has an outer edge forming a sloped guiding edge 3111, and the object inserting into the engaging space 23 movably abuts against the sloped guiding edge 3111. The sloped guiding edge 3111 has a lower end and an upper end extending divergently in the insertion direction of the object into the engaging space 23. The insertion of the object into the engaging space 23 is, therefore, not impeded by the clenching member 31.

The clenching member 31 is disposed on one of the front and back sides 221 and 222. The clenching member 31 has an end fixed to the engaging head and another end being a free end. The fixed end of the clenching member 31 and one of the front and back sides 221 and 222 of the engaging head respectively include a hole 313 and a first engaging hole 24. A first fastener 28 inserts into the hole 313 and the first engaging hole 24 and fastens the clenching member 31 on the engaging head.

The clenching member 31 is a thin plate that has a substantially smaller thickness than the thickness of the engaging head. Therefore, the clenching device 30 is configured to avoid making the clench wrench 10 too thick or not compact.

The clenching member 31 is resilient. The clenching member 31 is a metallic member. The clenching portion is at the free end of the clenching member 31. The clenching member 31 includes a middle portion between the fixed end and the free end. The middle portion and the fixed and free ends, in a lateral direction, each has a cross-sectional area, and the cross-sectional area of the middle portion is smaller than the cross-sectional areas of the respective fixed and free ends. The clenching portion is at the first position when not being operated.

The clenching member 31 has a main body 311 and includes a lever 312 protruding upwardly from the main body 311. The lever 312 facilitates the operation of the clenching member 31.

The engaging head includes a wall 27 disposed above and shielding the clenching member 31. The wall 27 includes a first engaging aperture 271, and a first fastener 28 inserts into the first engaging aperture 271 and fastens the wall 27 on the engaging head. One of the front and back sides 221 and 222 of the engaging head and the wall 27 respectively include a second engaging hole 25 and a second engaging aperture 272, and a second fastener 29 inserts in the second engaging hole 25 and second engaging aperture 272 and fastens the wall 27 on the engaging head.

A switch device 40 is interacted with the ratchet wheel 26 and is configured to releasably stop the ratchet wheel 26 from rotation. The switch device 40 includes an input control exposed from the engaging head. The switch device 40 includes an input control exposed from the engaging head. Therefore, a user of the clench wrench 10 can easily operate the switch device through the input control. Furthermore, the clenching member 31 has a thickness not greater than that of the input of the switch device 40. Therefore, the clenching device 30 is configured to avoid making the clench wrench 10 too thick or not compact.

A socket 90 is engaged with the clench wrench 10 and is prevented from disengaging therefrom when the clench wrench 10 clenches the socket 90 at a notch 92 defined on an outer periphery of the socket 90. The socket 90 includes a joining end configured to be insertable into the engaging space 23 and at least one recess 91 configured to be adapted to catch the clenching portion and the sloped guiding edge 3111. Therefore, the socket 90 is restrained by the clenching portion of the clenching member 31.

In view of the foregoing, the clench wrench 10 is configured for clenching the socket 90 engaged therewith, with the clenching device 30 moving to the first position preventing the socket 90 disengaging from the clench wrench 10. Furthermore, the clenching device 30 is moveable to the second position to disengage from the socket 90, thus allowing the socket 90 to disengage from the clench wrench 10.

The foregoing is merely illustrative of the principles of this invention, and various modifications can be made by those skilled in the art without departing from the scope and spirit of the invention.

What is claimed is:

1. A clench wrench comprising:

a structure including a first body defining a handle for a user to grasp and a second body defining an engaging head for engaging with an object to be clenched, wherein the engaging head includes an engaging space for receiving the object to be clenched and to be driven by the clench wrench, wherein the engaging head has two opposite sides with one side defining a front side and the other side defining a back side respectively, with the engaging space extending through the front and back sides and defining an opening each of the front and back sides; and a clenching device mounted on the engaging head, with the clenching device including a clenching member connected with the engaging head, wherein the clenching member includes a fixed end, a clenching portion at a free end opposite to the fixed end, and a middle portion extending between and interconnecting the fixed end and the clenching portion, wherein the middle portion and the fixed and free ends, in a lateral direction, each have a cross-sectional area, wherein the cross-sectional area of the middle portion is smaller than the cross-sectional areas of the respective fixed and free ends, wherein the fixed end is immovably fixed to the engaging head and includes an abutment surface abutting with a shoulder of the engaging head preventing pivoting of the fixed end relative to the engaging head, with the clenching member being resilient with the clenching portion being moveable relative to the fixed end when pushed to deform the middle portion from a first mode in which the clenching portion is located at a first position capable of clenching the object engaged with the engaging head and a second mode in which the clenching portion is disposed away from the engaging space and is located at a second position capable of letting the object engaged with the engaging head to disengage therefrom, with the middle portion being free of contact with the object to be clenched in the first and second members.

2. The clench wrench as claimed in claim 1 wherein the clenching member is disposed on one of the front and back sides of the engaging head.

3. The clench wrench as claimed in claim 2, wherein the fixed end of the clenching member and one of the front and back sides of the engaging head respectively include a hole and a first engaging hole, and wherein a first fastener inserts into the hole and the first engaging hole and fastens the fixed end of the clenching member on the engaging head.

4. The clench wrench as claimed in claim 3, wherein the clenching member is a metallic member.

5. The clench wrench as claimed 1, wherein the clenching portion is located at the first position when the clenching portion is not pushed.

6. The clench wrench as claimed in claim 1, wherein the clenching member is a metallic member.

7. The clench wrench as claimed in claim 1, wherein the clenching portion of the clenching member has an outer edge forming a sloped guiding edge, wherein the object inserting into the engaging space movably abuts against the sloped guiding edge, and wherein the sloped guiding edge has a lower end and an upper end extending divergently in an insertion direction of the object into the engaging space.

8. The clench wrench as claimed in claim 1, wherein the engaging space is defined by an inner periphery of a ratchet wheel, wherein the ratchet wheel is rotatably engaged with the engaging head and has a center of rotation about an axis, and wherein the axis extends in a thickness direction of the engaging head.

9. The clench wrench as claimed in claim 8 further comprising a switch device interacted with the ratchet wheel and configured to releasably stop the ratchet wheel from rotation, and wherein the switch device includes an input control exposed from the engaging head.

10. The clench wrench as claimed in claim 1, wherein the clenching member is a thin plate that has a substantially smaller thickness than a thickness of the engaging head.

11. The clench wrench as claimed in claim 1, wherein the engaging head includes a wall disposed above and shielding the clenching member.

12. The clench wrench as claimed in claim 11, wherein the fixed end of the clenching member and one of the front and back sides of the engaging head and the wall respectively include a hole and a first engaging hole and a first engaging aperture, and wherein a first fastener inserts into the hole and the first engaging hole and the first engaging aperture and fastens the clenching member and the wall on the engaging head.

13. The clench wrench as claimed in claim 12, wherein one of the front and back sides of the engaging head and the wall respectively include a second engaging hole and a second engaging aperture, and wherein a second fastener inserts into the second engaging hole and second engaging aperture and fastens the wall on the engaging head.

14. The clench wrench as claimed in claim 1, wherein the clenching member has a main body and includes a lever protruding upwardly from the main body.

* * * * *